US007267293B2

(12) United States Patent
Chen et al.

(10) Patent No.: US 7,267,293 B2
(45) Date of Patent: Sep. 11, 2007

(54) HIGH EFFICIENCY BOWL MILL

(75) Inventors: Michael M Chen, Naperville, IL (US); Jianrong Chen, Naperville, IL (US); David M. Podmokly, Downers Grove, IL (US)

(73) Assignee: Alstom Technology Ltd (CH)

( * ) Notice: Subject to any disclaimer, the term of this patent is extended or adjusted under 35 U.S.C. 154(b) by 179 days.

(21) Appl. No.: 11/128,248

(22) Filed: May 13, 2005

(65) Prior Publication Data

US 2006/0255195 A1 Nov. 16, 2006

(51) Int. Cl.
*B02C 15/04* (2006.01)
*B02C 15/00* (2006.01)

(52) U.S. Cl. ..... 241/119; 241/117; 241/118; 241/120; 241/121; 241/122

(58) Field of Classification Search ..... 241/117, 241/118, 119, 120, 121, 122
See application file for complete search history.

(56) References Cited

U.S. PATENT DOCUMENTS 3,465,971 A 9/1969 Dalenberg et al.
3,556,419 A 1/1971 Frangquist et al.
4,002,299 A 1/1977 Skalka
4,234,132 A 11/1980 Maliszewski
4,489,895 A * 12/1984 Petersen ..... 241/19
4,523,721 A * 6/1985 Maliszewski et al. ..... 241/61
4,981,269 A 1/1991 Koga et al.
5,597,124 A * 1/1997 Kessel et al. ..... 241/30
6,113,015 A 9/2000 Brundiek

* cited by examiner

*Primary Examiner*—Derris H. Banks
*Assistant Examiner*—Jason Y. Pahng
(74) *Attorney, Agent, or Firm*—Antonelli, Terry, Stout & Kraus, LLP

(57) ABSTRACT

A high efficiency bowl mill (100) is provided by the present invention. Included in the high efficiency bowl mill (100) is a plow (185) that is downstream of a grinding roll (180) on a grinding surface (145). The plow (185) loosens material that has been compacted by the grinding roll (180). Also included is a deflector (165) that redirects an air stream so as to pick up material loosened by the plow (185) and deposit material requiring further grinding. An outlet (201) of an inverted cone (200) is positioned so as to deposit material for pulverization on the grinding surface (145) and to restrict the air stream from entering the inverted cone (200).

8 Claims, 3 Drawing Sheets

HIGH EFFICIENCY BOWL MILL

FIELD OF THE INVENTION

The present invention is related to bowl mill pulverizers of the type that are used to effect therewith the pulverization of solid fossil fuels in particular, but it is to be understood are also capable of being used to effect therewith the pulverization of other materials such as gypsum, cement, minerals, etc., and more particularly to a high efficiency bowl mill pulverizer.

BACKGROUND OF THE INVENTION

Pulverizers for grinding different type materials are well known in the prior art. Pulverizers are also known as mills. Solid fossil fuels such as coal are one such material wherein there exists a need to grind the material in order to render the solid fossil fuel suitable for use in certain applications, although there are other materials such as gypsum, cement, minerals, etc. that need to be subjected to pulverization as well in order to permit their use in various applications. Fossil fuel fired power generation systems represent one such application in which it is desired to employ pulverized solid fossil fuel, e.g., coal as the fuel. Such a system is commonly referred to as a solid fossil fuel fired system. Pulverized solid fossil fuel firing is favored over other methods of burning solid fossil fuel because pulverized fossil fuel burns like gas and, therefore, fires are easily lighted and controlled.

For purposes of the discussion that follows, the solid fossil fuel fired systems referred to above typically consist of the following major operating components: a solid fossil fuel feeder, an apparatus for pulverizing solid fossil fuel, a distribution system for distributing the pulverized solid fossil fuel, a furnace in which the pulverized solid fossil fuel is to be burned, and the requisite controls for effecting the proper operation of the solid fossil fuel fired system. Of particular interest herein is the apparatus for pulverizing the solid fossil fuel, which will often be referred to hereinbelow as a solid fossil fuel pulverizer. Solid fossil fuel pulverizers are not new. They have been known to exist in the prior art for more than half a century. Furthermore, many improvements in the construction and/or mode of operation of solid fossil fuel pulverizers have been made during this period.

There are a number of features that it is advantageous for any solid fossil fuel pulverizer to possess, but particularly those which are designed for employment in a solid fossil fuel fired power generation system. Reference is had here to features such as reliability, low power consumption, minimum maintenance and high capacity. In addition, such a solid fossil fuel pulverizer advantageously should also be characterized by quiet operation, integrated lubrication systems, convenient adjustment and control of solid fossil fuel flow and fineness, and the ability to handle the high temperature air that is required for high moisture solid fossil fuel.

One particular type of conventional solid fossil fuel pulverizer is commonly referred to in the industry as a bowl mill. This solid fossil fuel pulverizer obtains its name by virtue of the fact that the pulverization, i.e., grinding, of the solid fossil fuel which takes place therein is effected on a grinding surface that in configuration bears a resemblance to a bowl. Reference may be had by way of exemplification to U.S. Pat. No. 3,465,971, which issued Sep. 9, 1969 to J. F. Dalenberg et al., and/or U.S. Pat. No. 4,002,299, which issued Jan. 11, 1977 to C. J. Skalka, both of the patents being assigned to the same assignee as the instant application, for a teaching of the nature of the construction and the mode of operation of a prior art form of bowl mill that is suitable for use in a solid fossil fuel fired power generation system to effectuate the pulverization of the solid fossil fuel that is to be burned as fuel therein.

As taught by the aforereferenced patents, and as is understood in the art, a bowl mill essentially consists of a body portion in which a grinding table is mounted for rotation, typically three grinding rollers each mounted on a suitably supported journal, also referred to herein as grinding journals, that interact with the grinding table to effect the grinding of material interposed therebetween, material supply means for feeding to the interior of the bowl mill the material that is to be pulverized, and air supply means for supplying to the interior of the bowl mill the air required in the operation of the bowl mill. In accordance with the mode of operation of such a bowl mill, the material, which enters the bowl mill, is pulverized by virtue of the interaction of the grinding rollers with the grinding table. After being pulverized, the particles of material are thrown outwardly by centrifugal force whereby the particles of material are fed into a stream of warm air that is entering the bowl mill. The stream of air with the particles of material entrained therein flows into a classifier in which coarse particles of material are removed from the air stream. These removed coarse material particles are then returned to the grinding table for further pulverization, while the fine particles of material are carried through the bowl mill in the air stream, and exit along with the air.

A typical bowl mill, under actual operating conditions, when employed in a solid fossil fuel fired system has a capacity to pulverize approximately 200,000 pounds of solid fossil fuel per hour, i.e., has a throughput of approximately 200,000 pounds of solid fossil fuel per hour. One manner in which to increase bowl mill throughput, i.e., increase efficiency, is to increase the speed at which the grinding table rotates. However, too great an increase in rotational speed results in unstable operation, known as a rumble mill condition, that does not result in an increase in throughput. That is, with an increase in rotational speed comes an increase in centrifugal force, throwing partially pulverized material off the grinding table. The partially pulverized material must be returned to the grinding table multiple times before the partially pulverized material is sufficiently pulverized. Also, operating at higher rotational speeds increases the power used by the bowl mill.

Other problems with known bowl mills relate to the condition of the material on the grinding table, often referred to as the material bed. In many bowl mills the material bed is not controlled for effective grinding. That is, the material on the grinding table to be provided to each grinding roller is not uniform across the surface of the grinding table, with some surface areas of the grinding table perhaps not having any material thereon, and with other surface areas of the grinding table having differing depths of material thereon. Also, material that has been pulverized by the grinding rollers sometimes adheres to the grinding table surface. This adhered material is not timely removed from the bowl. As a result, the adhered material is over pulverized by the grinding rollers.

One solution to the problem of increased centrifugal force associated with increased rotational speed is found in U.S. Pat. No. 6,113,015, which issued on Sep. 5, 2000 to Brundick and which is assigned on its face to Loesche GmbH. In the Brundick invention a damming roll is included in between each grinding roller. Material moving toward the outer edge of the surface of the grinding table, i.e., the dam ring, due to centrifugal force is blocked by the damming rolls. The damming rolls do not impart grinding force on the material that is to be pulverized. Rather, the purpose of the damming rolls is to keep the material on the grinding table surface, in opposition to the centrifugal force. The retaining of the material on the grinding table surface gives rise to at least one problem. In addition to coarse particles, the damming rolls also keep fine particles of materials on the grinding table surface, resulting in an over pulverization of the material.

U.S. Pat. No. 4,981,269, which issued on Jan. 1, 1991 to Tadayuki Koga et al. and which is assigned on its face to Ube Industries, Ltd., is directed to problems associated with the material bed, discussed above. In the Koga invention auxiliary rollers, also known as slave rolls, are arranged alternatively with the grinding rollers. These slave rolls condition, i.e., compact and smooth, the material bed for effective grinding. That is, the slave rolls operate to level the material on the grinding table surface before it encounters a grinding roller. Also, U.S. Pat. No. 4,234,132, which issued on Nov. 18, 1980 to Theodore V. Maliszewski et al. and which is assigned to the same assignee as the instant application, discloses a stand alone air deflector for leveling the material on the grinding table surface so as to present a uniform layer of material to the grinding rollers. That is, the deflector channels air over the surface of the grinding table to impart a leveling force on the material bed.

U.S. Pat. No. 3,556,419, which issued on Jan. 19, 1971 to Gustav Frangquist and which is assigned to the same assignee as the instant application, is directed to remedying the adhesion of material to the surface of the grinding table. In the Frangquist invention rakes are arranged alternatively with the grinding rollers. Each rake includes three tines for breaking up material that is adhered to, i.e., caked on, the grinding table surface.

No existing techniques are known which both address the problems associated with increased centrifugal force and the problems associated with the condition of the material bed discussed above. That is, the Brundick invention addresses the problems associated with increased centrifugal force, but not the problems associated with the condition of the material bed, and the Koga, Maliszewski, and Frangquist inventions address unique aspects of the problems associated with the condition of the material bed, but not the problems associated with increased centrifugal force. Accordingly, a need exists for a high efficiency pulverizer which overcomes all of the problems associated with the prior art discussed above.

OBJECTS OF THE INVENTION

It is an object of the present invention to provide a pulverizer which overcomes the deficiencies of existing pulverizers.

It is also an object of the present invention to provide a high efficiency pulverizer.

Yet another object of the present invention is to provide a high efficiency pulverizer in which the material bed is conditioned.

Still another object of the present invention is to provide a high efficiency pulverizer in which the material bed is conditioned and in which air flow is re-directed.

The above-stated objects, as well as other objects, features, and advantages, of the present invention will become readily apparent from the following detailed description which is to be read in conjunction with the appended drawings.

SUMMARY OF THE INVENTION

In accordance with the present invention, a high efficiency bowl mill is provided. High efficiency refers to the bowl mill of the present invention having a higher throughput, i.e., pulverization capacity, than existing bowl mills, while using the same amount of power as existing bowl mills, and while pulverizing material to the same level of fineness as existing bowl mills. The high efficiency bowl mill of the present invention has a substantially closed separator body and a grinding table that rotates in a first direction located inside the separator body. Material, such as coal or gypsum or cement or minerals, etc., is pulverized on the grinding surface. Also included in the bowl mill are multiple grinding rolls. The grinding rolls pulverize the material on the grinding table. An annular passage exists between the separator body and the circumference of the grinding surface.

The high efficiency bowl mill includes at least a plow and a deflector. The plow is positioned behind a grinding roll. As the grinding table rotates, the grinding rolls pulverize material on the grinding surface, and that pulverized material interacts with the plow. The plow loosens any material that becomes compacted on the grinding surface by the grinding rolls.

The deflector is mounted within the bowl mill. The deflector operates to cause the air flowing through the interior of the bowl mill, from the annular passage, to be directed toward the center of the bowl mill, which causes larger particles of pulverized material entrained in this air to lose their momentum and separate from the air for return to the grinding surface for further pulverization. Also, the redirected air picks up material loosened by the plow.

In one aspect of the present invention, the high efficiency bowl mill also includes an inverted cone mounted in the separator body. The inverted cone has an outlet at the bottom thereof that is positioned over the center of the grinding table. Coarse material for pulverization is ejected from this outlet. The ejected material could be material previously pulverized by the high efficiency bowl mill and rejected by a classifier, or could be material never before introduced to the high efficiency bowl mill. The outlet is positioned just over the grinding rolls. In other words, the outlet is positioned as far down in the separator body as possible without contacting the grinding rolls. This positioning restricts redirected air from entering the inverted cone. Alternatively, without departing from the essence of the present invention the cone outlet could be made smaller and possibly even extend below the grinding rolls a certain distance from the grinding table so as to thereby provide a clear passage for particle flow.

In one aspect of the present invention, the deflector includes an upper wall and a lower wall. The bottom of the upper wall is in contact with the top of the lower wall. This point of contact protrudes into the interior of the separator body. That is, the upper wall is angled downward toward the center of the high efficiency bowl mill, and the lower wall is angled upward toward this center. In a further aspect, the upper wall is angled downward at an angle from 20° to 40°, and the lower wall is angled upward at an angle from 30° to 50°. Even further, in some aspects of the present invention the lower wall includes a wear resistant liner. This liner can be formed of any material having the desired wear resistant qualities.

In another aspect of the present invention, the plow is a wedge having a leading edge and a trailing edge. The leading, i.e., narrower, edge is positioned opposite to a first direction, i.e., the direction of rotation of the grinding table. That is, the narrower, leading, edge of the wedge faces the direction of rotation of the grinding table. Also in this aspect, the wedge has an angle of incline that is from 10° to 30°. In yet another aspect of the present invention, the deflector extends over the plow. That is, the point of contact of the upper wall and the lower wall is closer to the center of the bowl mill than the plow such that looking down on the grinding surface one would see the deflector, not the plow.

According to still another aspect of the present invention, the high efficiency bowl mill includes three grinding rolls, and each grinding roll is associated with its own plow. Each of the three plows is positioned downstream of its grinding roll and loosens compacted material, as described above. In another aspect of the present invention, the plow is constructed of a wear resistant material which could be any material having the desired wear resistant qualities. According to yet another aspect of the present invention, the plow is mounted, by a mounting bracket, to either the deflector or the separator body.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT

Figure 1:
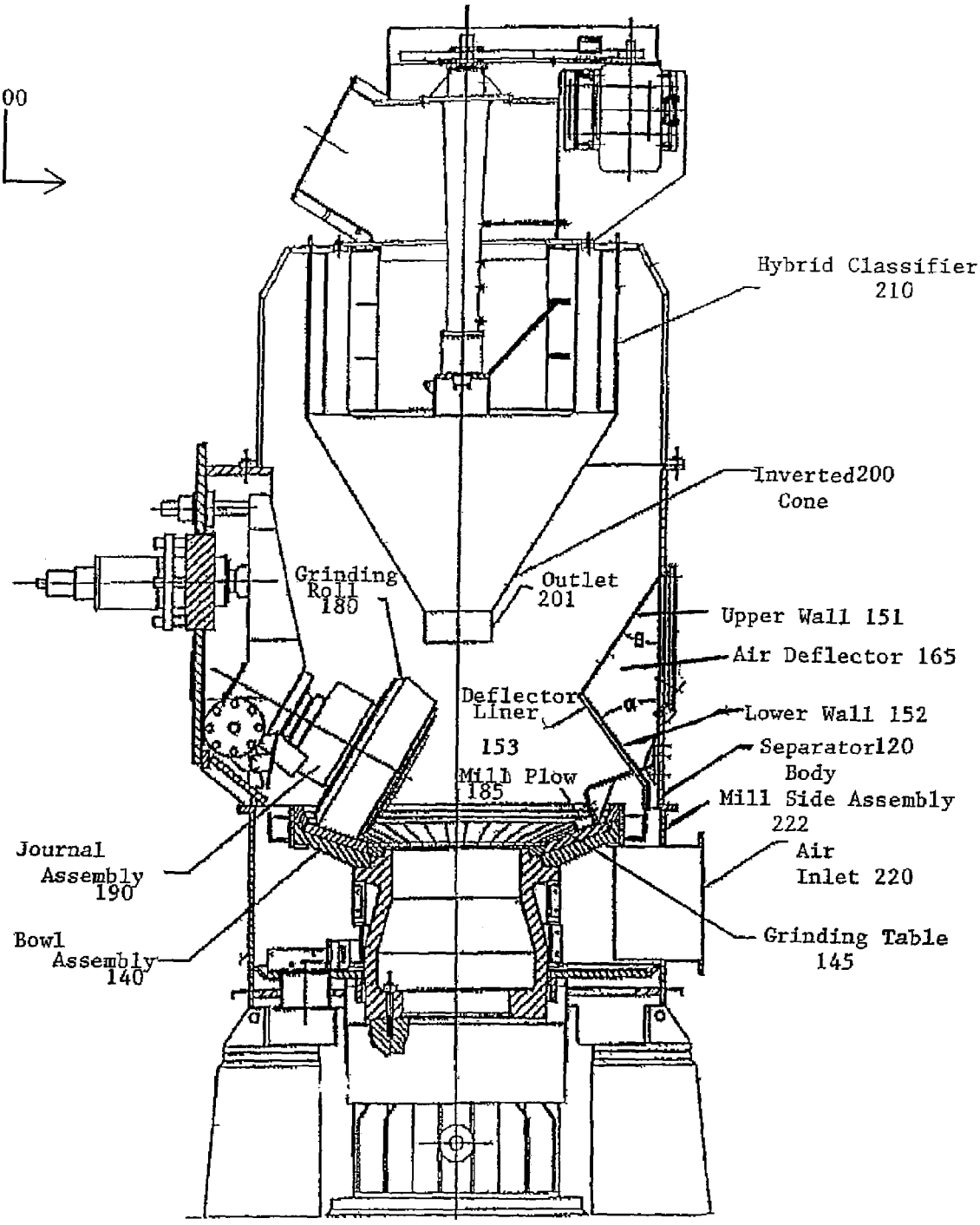
FIG. 1 is a side elevation view of a high efficiency bowl mill pulverizer with hybrid classifier in accordance with certain aspects of the present invention.
Figure 2:
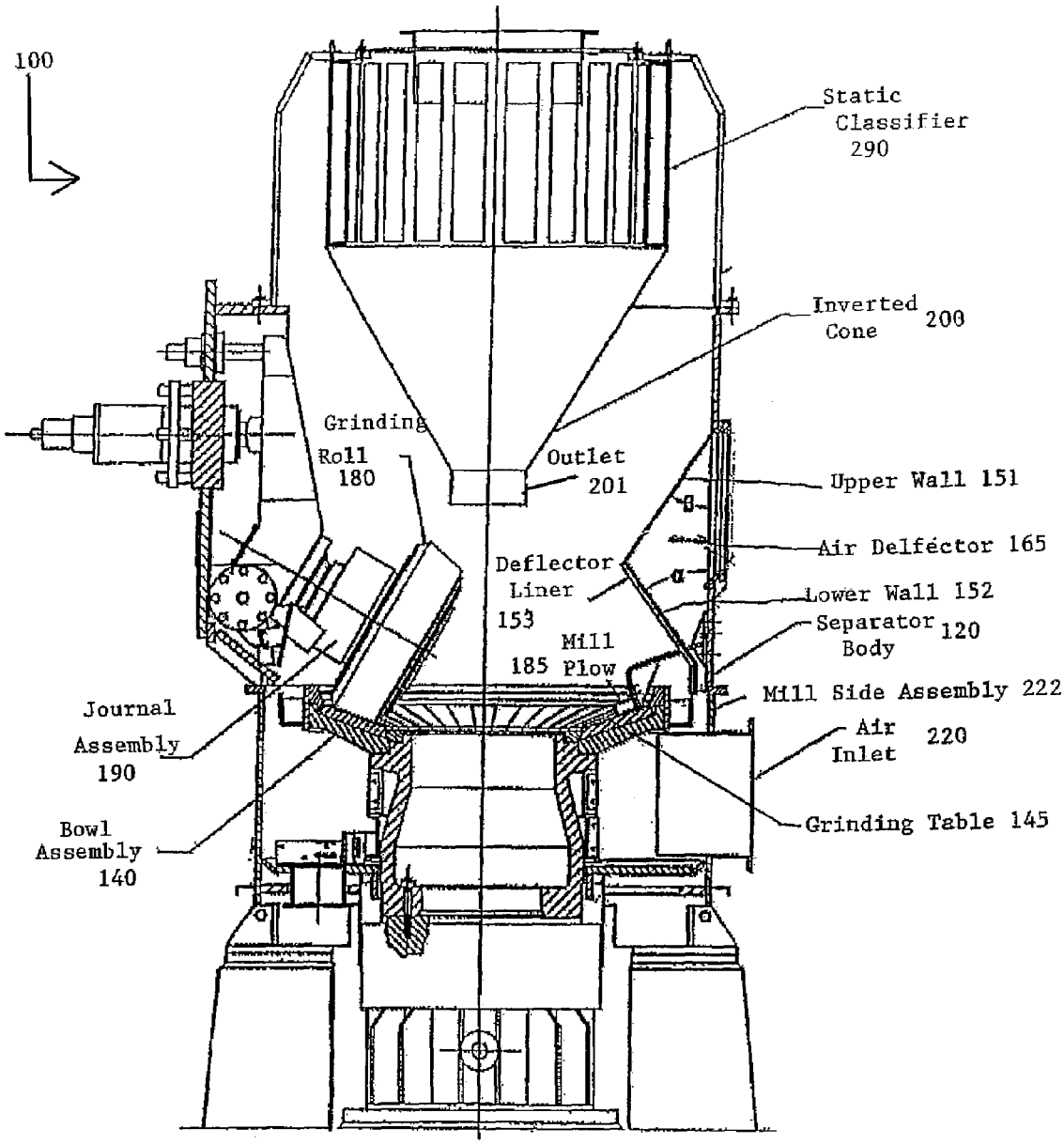
FIG. 2 is a side elevation view of the high efficiency bowl mill pulverizer with static classifier in accordance with certain aspects of the present invention.

FIGS. 1 and 2 depict a high efficiency pulverizing bowl mill, generally designated by reference numeral 100, constructed in accordance with the present invention. The high efficiency pulverizing bowl mill 100 as illustrated in FIG. 1 and FIG. 2 includes a substantially closed separator body 120. A bowl assembly 140 is mounted on a shaft (not shown), which in turn is operatively connected to a suitable drive mechanism (not shown) so as to be capable of being rotatably driven thereby. A plurality of grinding rolls 180, preferably three in number in accord with conventional practice, are each suitably supported within the interior of the separator body 120 by an associated journal assembly 190 so as to be equidistantly spaced one from another around the circumference of the separator body 120. In the interest of maintaining clarity of illustration in the drawing, only one such grinding roll 180 and journal assembly 190 have been shown in FIG. 1 and in FIG. 2.

The material, e.g., coal or gypsum or cement or minerals, etc., that is to be pulverized in the high efficiency bowl mill 100 is fed thereto by any suitable conventional form of feed means (not shown). Upon being discharged from the feed means the material enters the high efficiency bowl mill 100 by means of a material supply means (not shown) with which the separator body 120 is suitably provided. The material is discharged onto the surface of the bowl assembly 140, known as the grinding table 145. Also included is an inverted cone 200 that is a part of a classifier, which in the example of FIG. 1 is a hybrid classifier 210. However, as shown in FIG. 2, the classifier could also be a static classifier 290 without departing from the essence of the present invention.

In accordance with the mode of operation of the pulverizing bowl mill 100, a gas such as air is utilized to effect the conveyance of the material from the grinding table 145 through the interior of the separator body 120 for discharge from the pulverizing bowl mill 100 through the hybrid classifier 210 of FIG. 1 or the static classifier 290 of FIG. 2. The air that is used in this connection enters the separator body 120 through an air inlet 220. Typically, this air is warm air, the warmth for removing moisture from the coal. From the air inlet 220 in the mill side assembly 222 the air flows in surrounding relation from beneath the bowl assembly 140 to above the surface of the grinding table 145 of the bowl assembly 140. As the air is made to flow through the interior of the bowl mill 100, the material which is dispersed on the grinding table 145 is being pulverized by the action of the grinding rolls 180. As the material becomes pulverized, the particles that result are thrown outwardly by centrifugal force away from the center of the bowl assembly 140.

Upon reaching the outer edge of the circumference of the bowl assembly 140 the particles of material are picked up by the air flowing upwardly from beneath the bowl assembly 140 and are carried away therewith. Thereafter the stream of air with the particles of material entrained therein follows a tortuous path through the interior of the bowl mill 100, to be discussed below. In the course of following this tortuous path the larger of the particles of material separate from the air stream in which they are entrained and are made to return to the surface of the bowl assembly 140 whereupon they undergo further pulverization. The lighter of the particles of material, on the other hand, continue to be carried along in the air stream. Ultimately, the combined stream of air and those particles of material that remain entrained therein flows to a classifier, either the hybrid classifier 210 of FIG. 1 or the static classifier 290 of FIG. 2.

A classifier, either the hybrid classifier 210 of FIG. 1 or the static classifier 290 of FIG. 2, operates to effect a further sorting of the particles of material that remain in the air stream. Namely, those particles of pulverized material which are of the desired particle size pass through the classifier and along with the air are discharged from the bowl mill 100 through outlets (not shown). On the other hand, those particles of material which in size are larger than desired, i.e., coarse particles, are returned to the surface of the bowl assembly 140, via the inverted cone 200, whereupon they undergo additional pulverization. The inverted cone 200 provides a passage for rejected coarse particles to return to the bowl assembly 140 without interaction with the upward flow within the separator body 120 of the air with particles of material entrained therein. This return path contributes to high efficiency. Also, as desired, the inverted cone 200 can serve as the feed means, to which reference has been has hereinbefore, for the material to be pulverized.

The outlet 201 of the inverted cone 200 is preferably located as far down within the separator body 120 and over the grinding table 145 as possible, i.e., with a very slight clearance above the grinding rolls 180. This downward positioning of the outlet 201 minimizes air flow from the air deflector 165, to be discussed below, into the inverted cone 200. That is, the coarse particles are not again entrained after separation in the classifier and prior to their return to the grinding table 145. Alternatively, without departing from the essence of the present invention the cone outlet 201 could be made smaller and possibly even extend below the grinding rolls 180 a certain distance from the grinding table 145 so as to thereby provide a clear passage for particle flow.

Those particles of material returned to the grinding table 145 are subject to a repeat of the process described above. That is, these particles are thrown outwardly off the grinding table 145, are picked up by the air exiting from beneath the bowl assembly 140, are carried along with the air through the interior of the bowl mill 100, as the air stream follows the aforesaid tortuous path the coarser particles drop back onto the surface of the bowl assembly 140, the finer particles though continue to be carried along with the air to the classifier, those particles which are of the proper size pass through the classifier and exit from the bowl mill 100 through the outlets (not shown).

As shown in FIGS. 1 through 4, the high efficiency pulverizing bowl mill 100 also includes at least one mill plow 185 and an air deflector 165. The mill plow 185 loosens up any material that is caked on the grinding table 145. Once the caked material has been loosened by the mill plow 185, the air stream deflected by the air deflector 165, to be discussed further below, will remove the loosened material that is sufficiently ground. The loosened material that has not been sufficiently ground will remain on the surface of the bowl assembly 140. Due to the loosening, the remaining material will have a new angle of contact with the grinding rolls 180, providing for efficient grinding. It is to be understood that the present invention is still operable for its intended purpose even if the material is not caked on the grinding table 145.

Figure 3:
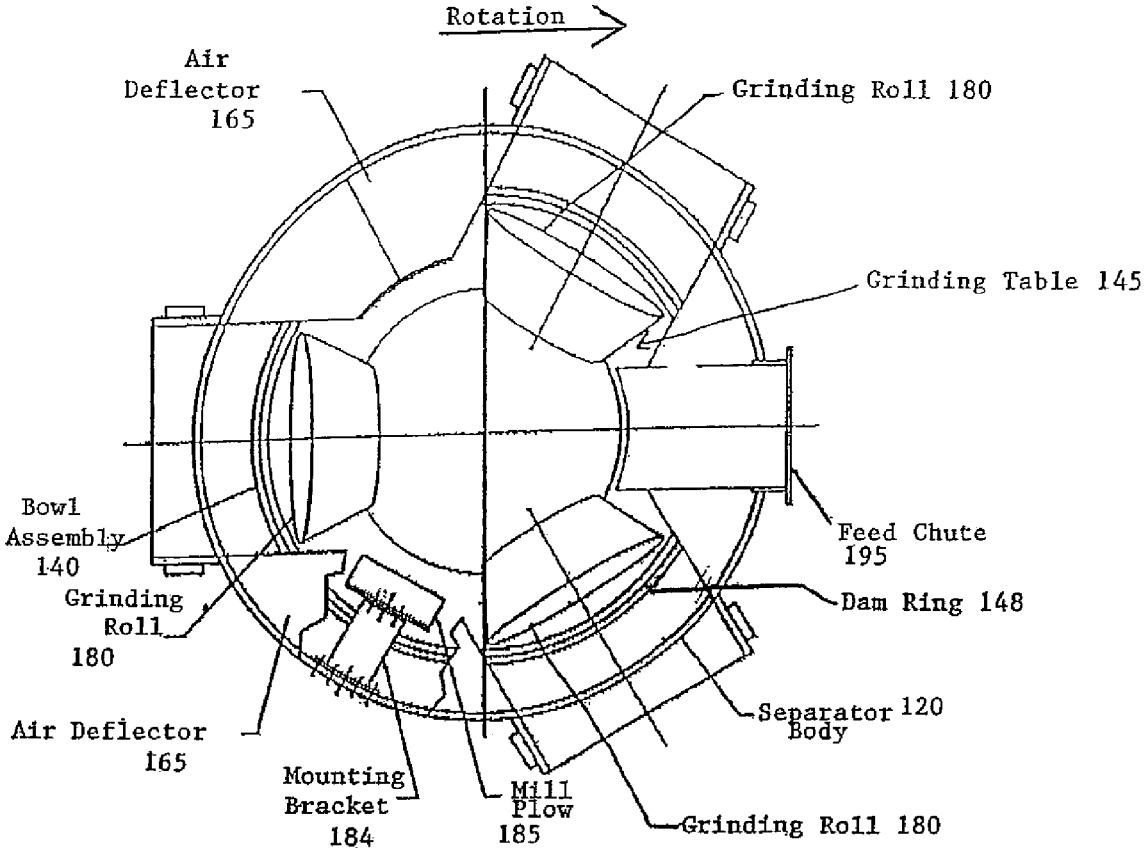
FIG. 3 is a top elevation view of the grinding table surface of the bowl mill pulverizer of FIG. 1 and FIG. 2 in accordance with certain aspects of the present invention.
Figure 4:
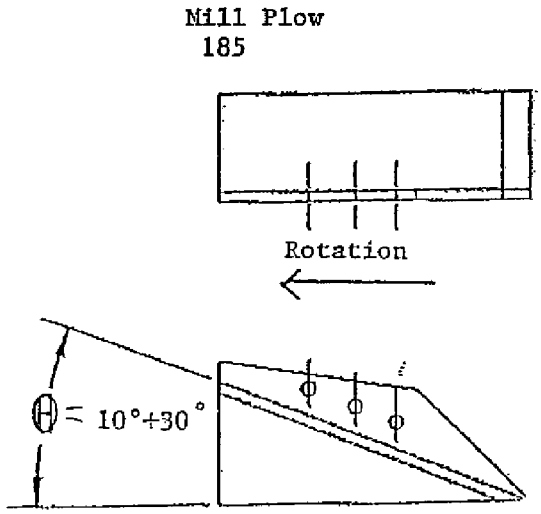
FIG. 4 is a side elevation view and a top elevation view of the mill plow shown in FIG. 1, FIG. 2, and FIG. 3.

The mill plow 185 preferably has a wedge shape, as shown best in FIG. 4. The wedge shaped mill plow 185 has an angle of incline, shown in FIG. 4 as an angle, of preferably 10 to 30 degrees. The width of the mill plow 185 is preferably approximately half the width of each grinding roll 180. The mill plow 185 is located in between two grinding rolls 180, as shown best in FIG. 3. When multiple mill plows 185 are utilized, each mill plow 185 is located between a different pair of grinding rolls 180. The mill plow 185 is preferably replaceable and made of a wear resistant material, such as Nihard, though any wear resistant material having the requisite qualities could be utilized as desired. Alternatively, though not shown in the Figures, the mill plow 185 can have a different shape than a wedge, such as, but not limited to, a rod or a bar so long as the mill plow 185 is still capable of performing its intended function in accordance with the present invention.

The mill plow 185 is preferably located close to the dam ring 148 of the grinding table 145 and in the path of the grinding rolls 180 with its leading edge against the direction of rotation of the bowl assembly 140. Also, the mill plow 185 is located proximate to the grinding table 145 such that compacted material on the grinding table 145 is disturbed, i.e., plowed, by the mill plow 185. Preferably, the mill plow 185 is not in contact with the grinding table 145, i.e., the surface of the bowl assembly 140. A mounting bracket 184 supports the mill plow 185. The mounting bracket 184 may be, as desired, attached to the interior of the separator body 120, as is shown in FIG. 3, or to the air deflector 165.

The air deflector 165 is mounted within the interior of the bowl mill 100 above the grinding table 145. The air deflector 165 is operative to cause the air stream, coming from beneath the bowl assembly 140 to be redirected toward the center of the bowl mill 100. This change in direction is effective to cause the larger, i.e., the coarser, particles of pulverized material entrained in the air stream to lose their momentum whereby they separate out of the air stream and are returned to the grinding table 145 for additional pulverization. As discussed above, the redirected air stream picks up the fine particles loosened by the mill plow 185, making for more efficient grinding.

The air deflector 165 preferably extends over the area of the grinding table 145 occupied by the mill plow 185 such that the outer edge of the grinding table 145 is located beneath the middle of the air deflector 165 in the radial direction. The air deflector 165 also extends around the interior of the separator body 120, breaking only for the grinding rolls 185 and, if present in a particular configuration, an optional feed chute 195 which serves as the material feed means, discussed above, for the material to be pulverized.

The air deflector 165 has an upper wall 151 that preferably is inclined with an angle similar to that of the inverted cone 200. This angle, shown as β in FIG. 1 and FIG. 2, is preferably from 20 to 40 degrees. The air deflector 165 also has a lower wall 152 that is inclined with an angle, shown as a in FIG. 1 and FIG. 2, of preferably 30 to 50 degrees. Also, preferably the lower wall 152 has a deflector liner 153 mounted thereon. The deflector liner 153 can be made of any material having the desired wear resistant qualities.

The combination of the mill plow 185, air deflector 165, and inverted cone 200 enables high efficiency to be realized with the bowl mill 100. That is, the bowl mill 100 has a higher throughput than existing bowl mills operating at the same power consumption level of the bowl mill 100. And, the bowl mill 100 has a higher throughput than existing bowl mills grinding material to the same level of particle fineness as the bowl mill 100. Also, a combination of just the mill plow 185 and the air deflector 165, also produces a very favorable grinding efficiency, however, the above-described triple combination provides even better efficiency.

The above-described invention can be utilized with any type of bowl mill having a grinding table 145 and grinding rolls 180. The present invention is not to be limited in scope by the specific embodiments described herein. Indeed, various modifications of the present invention in addition to those described herein will be apparent to those of skill in the art from the foregoing description and accompanying drawings. Thus, such modifications are intended to fall within the scope of the appended claims.

What is claimed is:

1. A high efficiency bowl mill having a substantially closed separator body having an interior surface, a rotatable grinding table mounted for rotation in a first direction within the separator body and upon which pulverization of material is effected, a dam ring provided on the rotatable grinding table so as to extend around the circumference of the rotatable grinding table, a plurality of grinding rolls for pulverizing the material on the rotatable grinding table, and an annular passage formed between the separator body and the dam ring provided on the rotatable grinding table, comprising:

an inverted cone mounted within the separator body such that an outlet at a lower end of said inverted cone is positioned with a clearance above the plurality of grinding rolls;

a deflector embodying a multiplicity of segments, each one of said multiplicity of segments being supported on the interior surface of the separator body so as to be located between a respective pair of the plurality of grinding rolls and above the plurality of grinding rolls;

a mill plow having a leading edge, a trailing edge, an angle of incline and a width equal to approximately half the width of each of the plurality of grinding rolls and positioned on a downstream side of a first one of the plurality of grinding rolls so as to be located close to the dam ring and in the path of the plurality of grinding rolls, and with the leading edge of said mill plow facing in the first direction of rotation of the rotatable grinding table, and said mill plow being operative to loosen any material that is caked on the rotatable grinding table; and wherein said inverted cone is operative to eject material for pulverization from the outlet at the lower end of said inverted cone onto a center of the rotatable grinding table, said deflector is operative to cause an air stream flowing through the annular passage from beneath the rotatable grinding table to be directed toward a center of the high efficiency bowl mill and such that the directed air stream is restricted from entering the outlet at the lower end of said inverted cone thereby causing (i) coarser particles of pulverized material entrained in the directed air stream to lose momentum and to separate from the directed air stream for return to the rotatable grinding table for further pulverization and (ii) material loosened by said mill plow to be entrained in the directed air stream, and the mill plow is attached within the interior of the separator body so that a respective one of the multiplicity of segments of said deflector overlies said mill plow.

2. The high efficiency bowl mill of claim 1, wherein:

the deflector includes an upper wall having an upper edge and a lower edge, and a lower wall having an upper edge and a lower edge;

the upper wall of the deflector is angled downward toward the center of the high efficiency bowl mill;

the lower wall of the deflector is angled upward toward the center of the high efficiency bowl mill; and the lower edge of the upper wall of the deflector is in contact with the upper edge of the lower wall of the deflector.

3. The high efficiency bowl mill of claim 2, wherein:

the angle of the upper wall of the deflector is from 20 degrees to 40 degrees from vertical; and the angle of the lower wall of the deflector is from 30 degrees to 50 degrees from vertical.

4. The high efficiency bowl mill of claim 2, wherein the lower wall of the deflector includes a wear resistant deflector liner.

5. The high efficiency bowl mill of claim 1, wherein:

the angle of incline of the mill plow is from 10 degrees to 30 degrees.

6. The high efficiency bowl mill of claim 1, wherein the plurality of grinding rolls is three grinding rolls and the mill plow is a first mill plow, and further comprising:

a second mill plow having a leading edge, a trailing edge, an angle of incline and a width equal to approximately half the width of each of the three grinding rolls and positioned on a downstream side of a second one of the three grinding rolls so as to be located close to the dam ring and in the path of the three grinding rolls, and with the leading edge of said second mill plow facing in the first direction of rotation of the rotatable grinding table, and said second mill plow being operative to loosen any material that is caked on the rotatable grinding table; and a third mill plow having a leading edge, a trailing edge, an angle of incline and a width equal to approximately half the width of each of the three grinding rolls and positioned on a downstream side of a third one of the three grinding rolls so as to be located close to the dam ring and in the path of the three grinding rolls, and with the leading edge of said third mill plow facing in the first direction of rotation of the rotatable grinding table, and said third mill plow being operative to loosen any material that is caked on the rotatable grinding table.

7. The high efficiency bowl mill of claim 1, wherein the mill plow is constructed of a wear resistant material.

8. The high efficiency bowl mill of claim 1, wherein the mill plow is attached within the interior of the separator body by means of a bracket mounted to one of the deflector and the separator body.

* * * * *